US005233363A

United States Patent [19]

Yarsunas et al.

[11] Patent Number: 5,233,363

[45] Date of Patent: Aug. 3, 1993

[54] CONNECTOR ASSEMBLY FOR FIXED TRIBAND ANTENNA

[75] Inventors: George D. Yarsunas, Vincentown; Michael L. Brennan, Howell; Frank Duggan, Trenton, all of N.J.

[73] Assignee: Radio Frequency Systems, Inc., Marlboro, N.J.

[21] Appl. No.: 794,936

[22] Filed: Nov. 20, 1991

[51] Int. Cl.[5] ..... H01Q 1/10; H01Q 1/32; H01Q 5/00

[52] U.S. Cl. ..... 343/715; 343/901; 343/906

[58] Field of Search ..... 343/715, 901, 905, 906

[56] References Cited

U.S. PATENT DOCUMENTS 4,353,075 10/1982 Eduards ..... 343/901
4,734,703 3/1988 Nakase et al. ..... 343/715
4,748,450 5/1988 Hines et al. ..... 343/715
5,030,964 7/1991 Nakanishi ..... 343/715

FOREIGN PATENT DOCUMENTS 2246986 5/1975 France ..... 343/715

*Primary Examiner*—Michael C. Wimer
*Attorney, Agent, or Firm*—Ware, Fressola, Van Der Sluys & Adolphson

[57] ABSTRACT

A vehicular multi-band antenna is adapted to receive signals in the AM/FM bands and to receive and transmit signals in a significantly higher frequency band such as that used for cellular telephone. The antenna is provided with a base section fixedly mounted on the vehicle and a removable antenna mast section removably received in the base section.

31 Claims, 3 Drawing Sheets

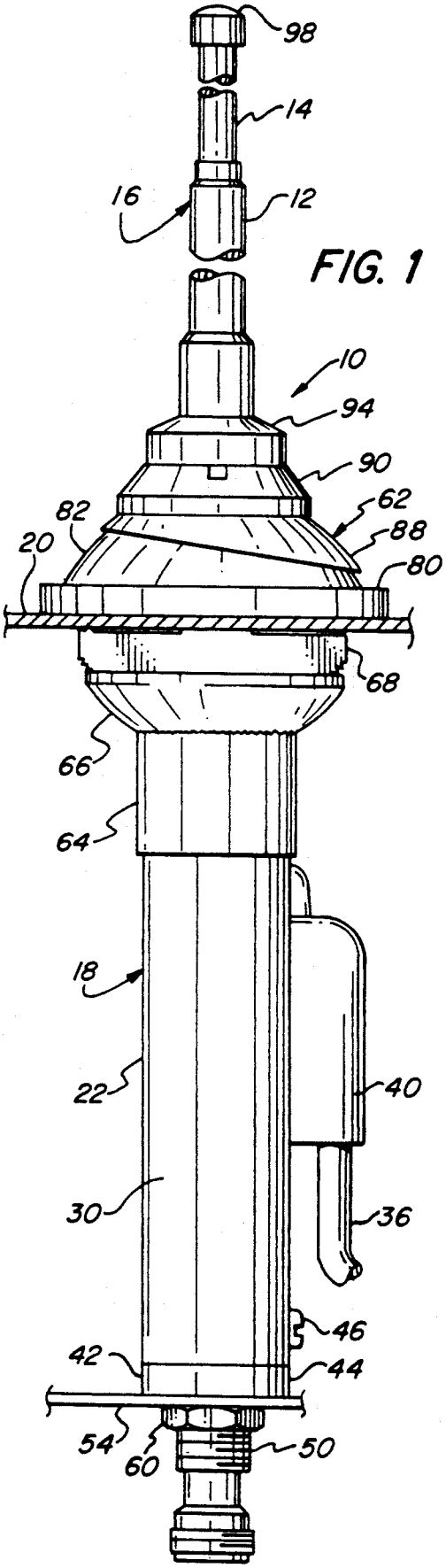
FIG. 1
FIG. 2
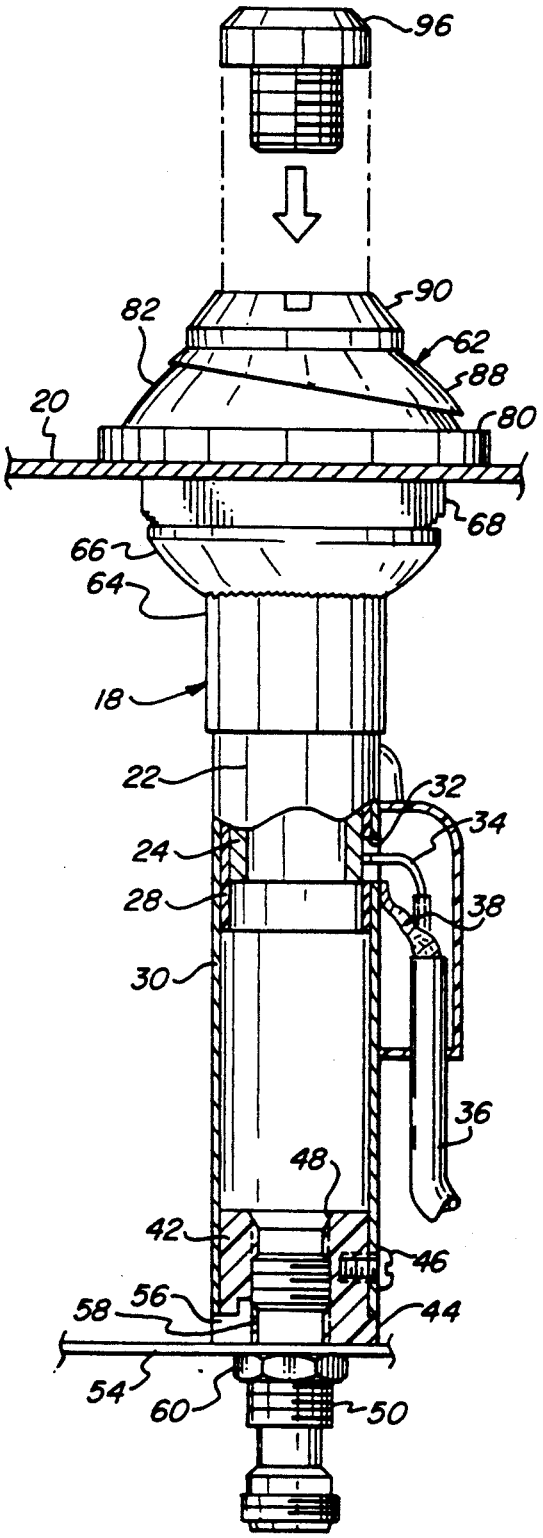

CONNECTOR ASSEMBLY FOR FIXED TRIBAND ANTENNA

BACKGROUND OF THE INVENTION

1. Field of the Invention

The present invention relates to vehicular antennas and more particularly to antennas adapted to receive AM/FM radio signals and to receive and transmit higher-frequency signals, such as cellular telephone signals.

2. Description of the Prior Art

Cellular telephone service is becoming exceedingly popular and is very much in demand. Since cellular telephones operate in a frequency band considerably higher than the normal AM/FM radio, separate cellular telephone antennas must be installed on vehicles. Initially, the existence of the cellular antenna on a vehicle was a status symbol but it is now considered a pretentious display that is to be avoided by those in the service industry. Automobile owners dislike the unsightly objects extending from their vehicles and the need for multiple feed cable holes in the vehicle's exterior for body mounted antennas. In addition, cellular telephones are common targets for thieves, and the cellular antenna is literally a flag directing potential thieves to the desired vehicles.

It is desirable to remove a cellular antenna from the exterior of the vehicle so the vehicle is not as apt to become a target for thieves. Additionally, a removable antenna leaves the vehicle's lines clean and streamline when the radio is not in use. Removable antennas are also desirable since the antennas, if they are not removable, are commonly damaged when the vehicle passes through a car wash.

It is also desirable to provide a single multi-band antenna which can handle both the AM/FM commercial broadcast frequencies and the cellular telephone frequencies. Multi-band antennas have been provided for use with CB radios as illustrated in U.S. Pat. Nos. 4,095,229 and 4,325,069. Such antennas may be coupled through a single feed line to a splitter to separate the AM/FM and CB radio frequencies. In other situations, a loading coil is provided on the antenna itself to produce an effective length suitable for transmission and reception of the desired frequency band.

The numerous devices of the prior art provide triband antennas for AM/FM reception and cellular telephone service; however, in general the prior art antennas exhibit a high voltage standing wave ratio (VSWR), poor isolation between the cellular and AM/FM antenna portions, a radiation pattern off the horizontal axis, poor impedance and pattern bandwidth. In addition, the prior art antennas do not provide the desired removability.

SUMMARY OF THE INVENTION

The present invention contemplates a multi-band antenna with a base section fixed to the vehicle and a removable antenna mast section comprising a typical AM/FM tubular antenna terminating at its distal upper end with a center-fed coaxial dipole antenna for receiving and transmitting the cellular band. A feedline for the cellular antenna extends through the tubular AM/FM antenna terminating at a lower distal connection end of the removable antenna mast section.

In the present invention, the removable antenna mast section of the antenna has a lower member forming the AM/FM antenna and the uppermost member forming the cellular antenna. A lower distal connection end of the removable antenna mast section serves to couple the removable section with the fixed base section of the antenna mounted on the vehicle.

A primary objective of the present invention is to provide a triband antenna for AM/FM radio and cellular telephone bands having an easily removable antenna mast section.

Another objective of the present invention is to provide a triband antenna having a fixed base section secured to the vehicle and a removable antenna mast section having a lower distal connection end for seating within the fixed base section.

An additional objective of the present invention is to provide a triband antenna wherein there is minimal coupling between the cellular portion and the AM/FM antenna portion.

A further objective of the present invention is to provide a triband antenna that is economically fabricated and will enjoy a long life in operation.

Our invention will be fully understood when reference is made to the following detailed description taken in conjunction with the accompanying drawings.

DESCRIPTION OF THE DRAWINGS

FIG. 1 is a side elevational view of an antenna constructed in accordance with the present invention as mounted on a vehicle.

FIG. 2 is a side elevational view of a fixed base section of the antenna of FIG. 1 with portions broken away to show internal structure and also shown is a protective plug being inserted in end thereof.

DETAILED DESCRIPTION OF THE INVENTION

Figure 3:
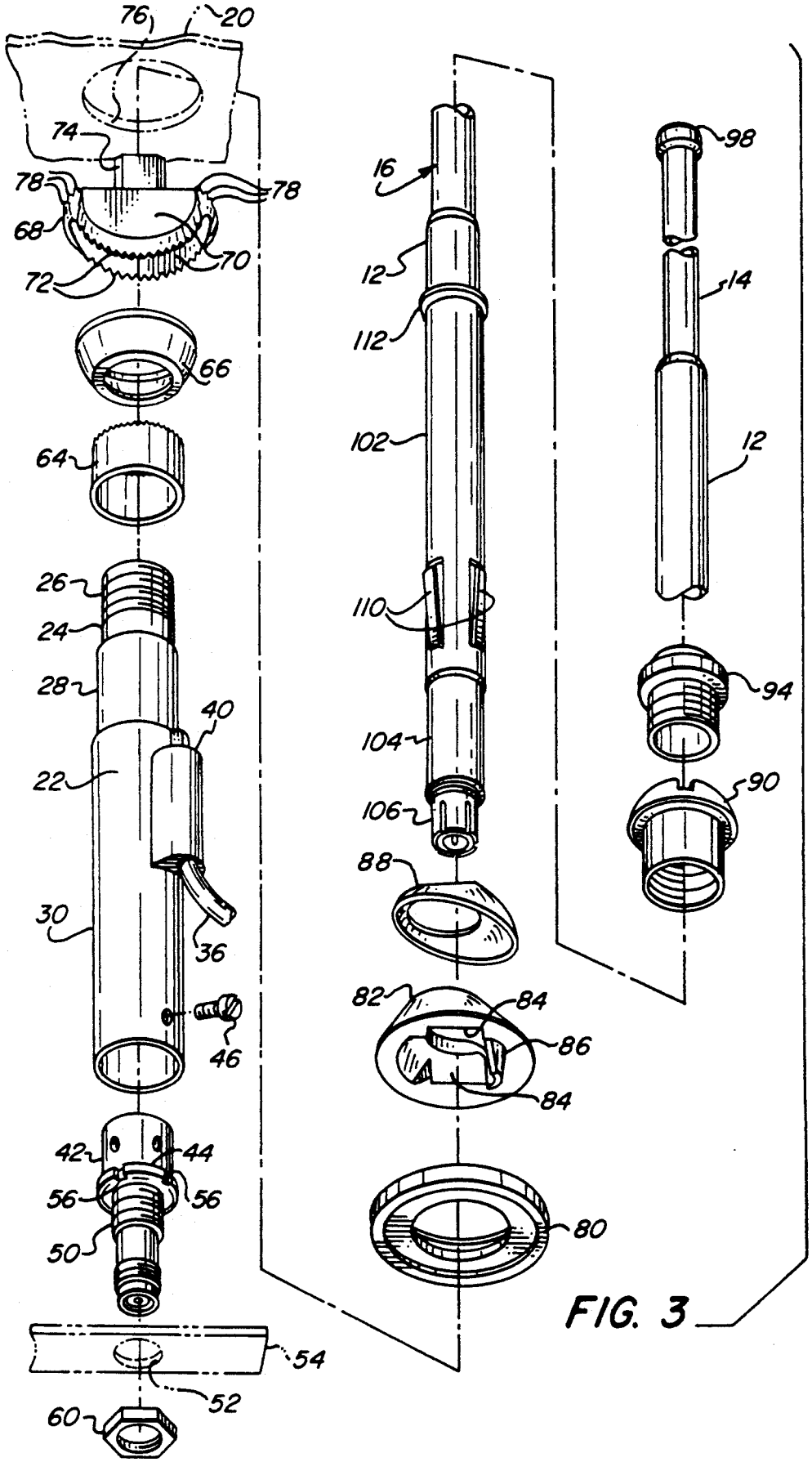
FIG. 3 is an exploded view of the antenna of FIG. 1.

FIG. 1 illustrates a triband antenna generally indicated by numeral 10 including two coaxially arranged sections 12 and 14 forming a removable antenna mast section generally indicated by the numeral 16 which extends from a base section generally indicated by the numeral 18 which is typically fixedly mounted to a fender 20 of a vehicle. Referring also to FIG. 2, the base section 18 includes a connector assembly 22. The connector assembly 22 is provided with an inner connector sleeve 24 formed preferably of brass with a threaded upper end 26 (FIG. 3). The inner connector sleeve 24 is molded in place within a middle connector sleeve 28 injection molded of a plastic resin such as polypropylene or polyethylene. An outer connector sleeve 30 surrounds the lower end of the middle connector sleeve 28. The middle connector sleeve 28 and outer connector sleeve 30 are provided with an aperture 32 which allows a center conductor 34 of a AM/FM cable 36 to be connected to the inner connector sleeve 24. A braid element 38 of the AM/FM cable 36 is connected to the outer connector sleeve 30. To protect this connection, a plastic AM/FM pickoff shroud 40 encapsulates the end of the AM/FM cable 36 thereby forming an AM/FM pickoff connector.

Inserted in the lower end of the outer connector sleeve 30 is a ground bushing 42 having a flange 44 which seats the outer connector sleeve 30. The ground bushing 42 is held in assembly with the outer connector sleeve 30 by a screw 46. The ground bushing 42 has a threaded axially extending aperture 48 dimensionally sized to receive a TNC coaxial dual receptacle 50. The TNC coaxial dual receptacle 50 extends through an aperture 52 (FIG. 3) in a universal mounting strap 54 whereby the flange 44 of the ground bushing 42 abuts the universal mounting strap 54. The flange 44 has a plurality of slots 56 while the TNC coaxial dual receptacle 50 has a thru hole 58 therein to drain any water which might accumulate inside the connector assembly 22. The ground bushing 42 is made of brass plated with tin to ground the antenna 10 to the universal mounting strap 54. A lock nut 60 is threadingly received on the exterior of the TNC coaxial dual receptacle 50 to secure the antenna 10 to the universal mounting strap 54. As will be appreciated by those skilled in the art, the free end of the TNC coaxial dual receptacle 50 can be attached to a coaxial cellular jumper cable (not shown) for conveying cellular transmission signals to and from a transceiver (not shown) located in the vehicle.

Connection of the connector assembly 22 of the base section 18 to the fender 20 is accomplished by use of a mounting apparatus generally indicated by numeral 62. Underneath the fender 20, the connector assembly 22 is provided with a tubular spacer 64 surrounding the middle connector sleeve 28 and abutting the outer connector sleeve 30 at the upper end thereof. Seated on the tubular spacer 64 is a chrome plated steel cup lock member 66 with a swivel lock member 68 thereabove. The swivel lock member 68 has two parallel semi-circular sidewalls 70 with a plurality of teeth 72 thereon allowing the swivel lock member 68 to be positioned to accommodate various angular orientations (up to 21.5°) of the fender 20. The upper edge of each sidewall 70 has a thin elongated straight extension 74 extending through a hole 76 (FIG. 3) in the fender 20. Sharpened nubs 78 are provided on an upper side of the swivel lock member 68 to engage the inner surface of the fender 20 thereby inhibiting relative movement of the antenna 10. The mounting apparatus 62 above the fender 20 includes a rubber seal grommet 80 in the form of a resilient annulus in which a plastic universal mounting dome 82 is seated. The universal mounting dome 82 has diametrically opposed interior slots 84 which receive the extensions 74 of the swivel lock member 68. A curved cantilevered finger 86 extends downwardly from the universal mounting dome 82 through the seal grommet 80, the fender 20 and into the interior of the swivel lock member 68. A steel black chrome plated shroud 88 provides a protective covering for the seal grommet 80. To secure the connector assembly 22 to the fender 20, a black chrome plated threaded mounting adaptor 90, made of brass, is threadingly received on the threaded upper end 26 of the inner connector sleeve 24. The threaded mounting adaptor 90 thereby extends through the universal mounting dome 82 and the shroud 88. The threaded mounting adaptor 90 includes an interior shoulder 92 functioning as an abutment stop for the threaded upper end 26 and also for an antenna locking nut 94. A threaded plug 96 shown in FIG. 2 is also provided to replace the antenna locking nut 94 when the removable antenna mast section 16 is removed from the base section 18.

To install the base section 18, a suitable mounting location is selected on the front or rear fender. The chosen location should have enough clearance on the underside to accommodate the base section 18. A $\frac{7}{8}$ inch hole 76 is drilled in the selected location. If the hole 76 already exists, its diameter should be checked. Paint and undercoating is removed from the underside to ensure proper grounding of the antenna 10. The connector assembly 22, tubular spacer 64, cup lock member 66 and swivel lock member 68 are installed from the underside of the fender 20 with the threaded upper end 26 and extensions 74 protruding through the hole 76 of the fender 20. The seal grommet 80, universal mounting dome 82, shroud 88 and threaded mounting adaptor 90 are installed until the shoulder 92 of the threaded mounting adaptor 90 engages the threaded upper end 26 to hold the base section 18 firmly in place. The universal mounting strap 54 is bent as required and its free end attached to an acceptable inner panel (not shown) of the vehicle. With the TNC coaxial dual receptacle 50 positioned through the aperture 52, the lock nut 60 is then tightened on the TNC coaxial dual receptacle 50 to hold the base section 18 and universal mounting strap 54 in place. The AM/FM cable 36 and a cellular jumper cable (not shown) are connected to the radio and transceiver as appropriate.

Figure 4:
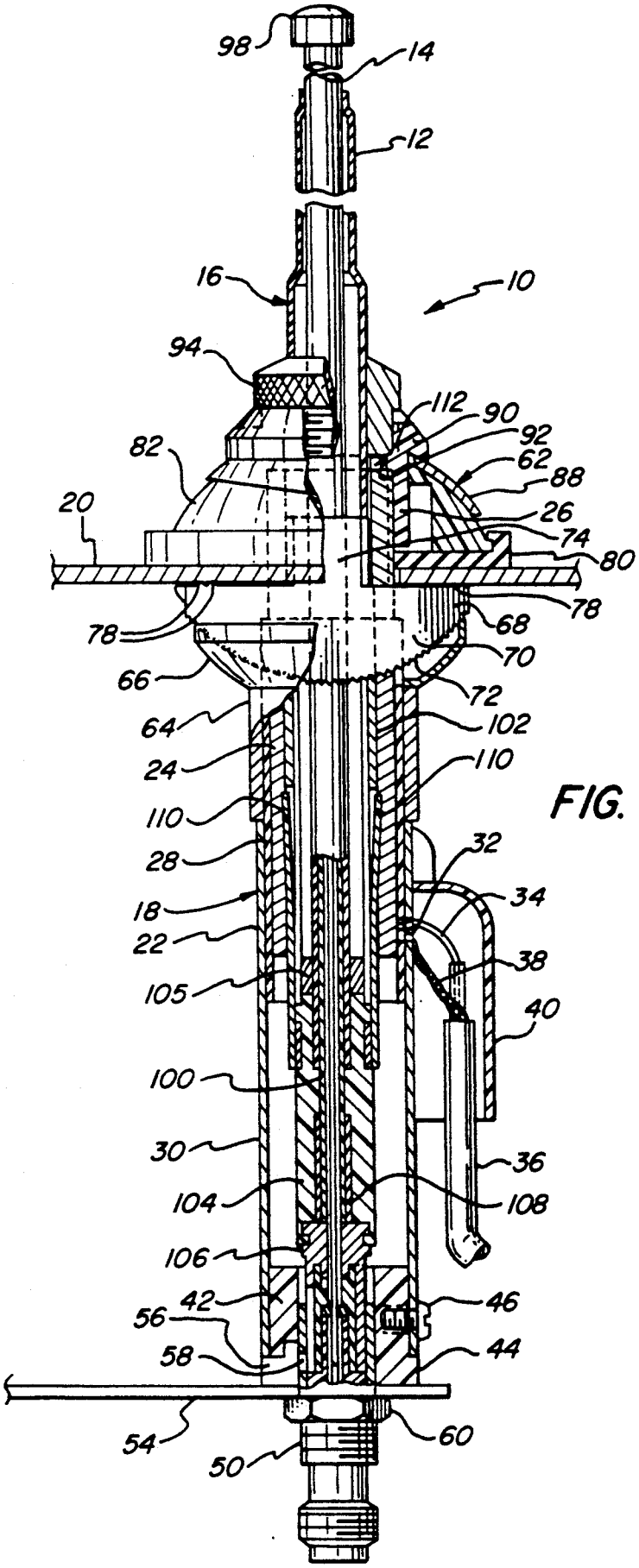
FIG. 4 is a side elevational view of the antenna similar to FIG. 1 but with portions broken away to show internal structure.

The removable antenna mast section 16 can then be inserted in the base section 18 as will be explained further hereinafter. Referring to FIGS. 3 and 4, the AM/FM antenna section 12 of the removable antenna mast section 16 is preferably formed of a brass or stainless steel stepped-down tube which may be plated on the exterior surface for ornamental and corrosion-resistance purposes. Section 14 has a cap 98 and is formed of a fiberglass material and functions as a radome in which the cellular antenna portion (not shown) is mounted. The cellular antenna portion comprises a center-fed half-wave dipole antenna (not shown) comprising a whip portion (not shown) and a coaxial skirt (not shown). The dipole is fed by a 50-ohm coaxial feed line cable 100 which extends upwardly through the cellular antenna section 14 of the antenna 10.

The details of the configuration for the antenna design can be found in U.S. Pat. No. 5,079,562 entitled MULTI-BAND ANTENNA issued Jan. 7, 1992 to inventors George D. Yarsunas, Michael L. Brennan and James R. Hendershot.

The AM/FM antenna section 12 and cellular antenna section 14 extend into a slide contact sleeve 102 in a force fit relationship and terminate in an injection molded sleeve 104. An inner plug 105 provides a stop for the injection molded sleeve 104 during the manufacturing process. The lower portion of the AM/FM antenna section 12 has two or more holes therethrough to allow the injection molded sleeve 104 to mechanically connect thereto. The coaxial feed line cable 100 extends completely through the injection molded sleeve 104 to a TNC straight plug 106. The TNC straight plug 106 is a modified TNC connector with its outer body housing removed so that it engages the TNC coaxial dual receptacle 50 when the removable antenna mast section 16 is inserted in the base section 18. The TNC straight plug 106 is securely connected to the coaxial feed line cable 100 by means of a crimped ferrule 108 made of nickel plated brass locking the braid (not shown) of the cable 100 to the barbed end (not shown) of the plug 106.

The slide contact sleeve 102 is made of beryllium-copper (or a similar metal) and has four cantilevered resilient fingers 110 spaced ninety degrees apart. The cantilevered resilient fingers 110 maintain contact between the slide contact sleeve 102 and the inner connector sleeve 24 to complete the AM/FM circuit. The upper end of the slide contact sleeve 102 has a flange 112 which acts as an abutment stop when the removable antenna mast section 16 is inserted in the base section 18.

As seen is FIG. 3, when the removable antenna mast section 16 is fully inserted in the base section 18 with the flange 112 abutting the threaded upper end 26 of the inner connector sleeve 24, the antenna locking nut 94 can be threadingly received in the threaded mounting adaptor 90 until the antenna locking nut 94 bottoms out on the shoulder 92 thereby sandwiching the flange 112 between the threaded upper end 26 of the inner connector sleeve 24 and the antenna locking nut 94. In this fashion, the removable antenna mast section 16 is held firmly in the base section 18.

To remove the removable antenna mast section 16, the procedure is reversed. The user must first remove the antenna locking nut 94 whereby the removable antenna mast section 16 can then be pulled axially out of the base section 18. With the removable antenna mast section 16 removed, the threaded plug 96 can be inserted in the threaded mounting adaptor 90 as shown in FIG. 2.

Thus, the present invention provides a triband antenna with a removable antenna mast section capable of receiving signals in the AM/FM commercial radio bands and receiving and transmitting cellular telephone signals. The antenna has a unique removable connection used to transfer both the cellular and AM/FM signals to the respective transceiver and radio.

The preferred embodiment described above admirably achieves the objects of the invention; however, it will be appreciated that departures can be made by those skilled in the art without departing from the spirit and scope of the invention which is limited only by the following claims.

What is claimed is:

1. A vehicle antenna for receiving Am/FM radio signals and for receiving and transmitting high frequency signals, comprising:

A. a base section configured to be fixed to the vehicle, comprising:

i. a connector assembly having a first coaxial connector at a lower end, said first coaxial connector being configured to connect to both a coaxial cable for conducting the high frequency signals and a second coaxial connector for a mating relationship therewith, said connector assembly provided with an AM/FM pickoff connector to operationally connect an AM/FM cable for conducting the Am/FM radio signals, ii. mounting means for securing said connector assembly to the vehicle, said mounting means including means for engaging an upper end of said connector assembly and means for engaging the vehicle in a clamping relationship;

B. A removable antenna mast section removably received in said base section, comprising:

i. a slide contact sleeve received within said base section and having a second coaxial connector at one end, said first and second coaxial connectors being in a mating relationship to conduct high frequency signals therebetween, ii. AM/FM tubular antenna portion extending from another end of said contact sleeve and being operationally connected to said AM/FM pickoff connector for conducting AM/FM signals, iii. a high frequency antenna portion mounted to said AM/FM tubular antenna portion and said contact sleeve for receiving and transmitting high frequency signals, said high frequency antenna portion being operationally connected to said second coaxial connector; and C. means for releasably retaining said removable antenna mast section within said base section.

2. A vehicle antenna as described in claim 1, wherein said connector assembly has a tubular configuration for receiving said slide contact sleeve.

3. A vehicle antenna as described in claim 2, wherein said slide contact sleeve has an abutment stop means for positioning of said removable antenna mast section in said base section.

4. A vehicle antenna as described in claim 1, wherein said slide contact sleeve has resilient means thereon for providing positive electrical contact between said slide contact sleeve and said connector assembly to complete a circuit with said AM/FM pickoff connector for conducting the AM/FM radio signals.

5. A vehicle antenna as described in claim 4, wherein said resilient means are cantilevered fingers on said slide contact sleeve.

6. A vehicle antenna as described in claim 1, wherein said slide contact sleeve, AM/FM tubular antenna portion and high frequency antenna portion terminate in a molded element which holds them in assembly.

7. A vehicle antenna as described in claim 6, wherein said second coaxial connector is held in assembly with said slide contact sleeve, AM/FM tubular antenna portion and high frequency antenna portion by said molded element.

8. A vehicle antenna as described in claim 7, wherein said high frequency antenna portion is operationally connected to said second coaxial connector by a coaxial feed line which extends through said molded element.

9. A vehicle antenna as described in claim 1, wherein said connector assembly has a tubular configuration.

10. A vehicle antenna as described in claim 9, wherein said first coaxial connector is mounted in a bushing located in the lower end of said connector assembly.

11. A vehicle antenna as described in claim 9, wherein said connector assembly includes an inner connector sleeve, a middle connector sleeve and an outer connector sleeve.

12. A vehicle antenna as described in claim 11, wherein said inner connector sleeve is electrically insulated from said outer connector sleeve by said middle connector sleeve.

13. A vehicle antenna as described in claim 12, wherein said inner connector sleeve contacts said slide contact sleeve to operationally connect said AM/FM tubular antenna portion to a center conductor of said AM/FM pickoff connector.

14. A vehicle antenna as described in claim 13, wherein an outer braid conductor of said AM/FM pickoff connector is connected to said outer connector sleeve.

15. A vehicle antenna as described in claim 11, wherein said mounting means engages said inner connector sleeve of said connector assembly.

16. A vehicle antenna as described in claim 15, wherein said mounting means is provided by a threaded nut for engaging said inner connector sleeve.

17. A vehicle antenna as described in claim 11, wherein said slide contact sleeve has an abutment stop means which seats on an upper end of said inner connector sleeve for positioning said removable antenna mast section.

18. A vehicle antenna as described in claim 17, wherein said mounting means engages said inner connector sleeve of said connector assembly.

19. A vehicle antenna as described in claim 18, wherein said mounting means is provided by a threaded nut for engaging said inner connector sleeve.

20. A vehicle antenna as described in claim 19, wherein said means for retaining said removable antenna mast section engages said abutment stop means and holds said removable antenna mast section against said inner connector sleeve.

21. A vehicle antenna as described in claim 17, wherein said means for retaining said removable antenna mast section engages said abutment stop means and holds said removable antenna mast section against said inner connector sleeve.

22. A vehicle antenna as described in claim 1, wherein said means for engaging the vehicle includes a swivel lock means which permits said base section to accommodate various angular orientations on the vehicle.

23. A vehicle antenna as described in claim 1, wherein said mounting means is provided by a threaded nut engaging said upper end of said connector assembly.

24. A removable antenna mast for receiving AM/FM radio signals and for receiving and transmitting high frequency signals for use in combination with a base section configured to be fixed to a vehicle, the base section comprising a connector assembly having a first coaxial connector at a lower end, the first coaxial connector being configured to connect to both a coaxial cable for conducting the high frequency signals and a second coaxial connector for a mating relationship therewith, the connector assembly provided with an AM/FM pickoff connector to operationally connect an AM/FM cable for conducting the AM/FM radio signals, and mounting means for securing the connector assembly to the vehicle, said mounting means including means for engaging an upper end of the connector assembly and means for engaging the vehicle in a clamping relationship;

at least a portion of said removable antenna mast being dimensionally sized to be removably received in the base section and said removable antenna mast comprising:

A. slide contact sleeve dimensionally sized to be received within the base section and having a second coaxial connector at one end, said first and second coaxial connectors being dimensionally sized for a mating relationship to conduct high frequency signals therebetween;

B. AM/FM tubular antenna portion extending from another end of said contact sleeve and configured to be operationally connected to the AM/FM pickoff connector for conducting AM/FM signals; and C. a high frequency antenna portion mounted to said AM/FM tubular antenna portion and said contact sleeve for receiving and transmitting high frequency signals, said high frequency antenna portion being operationally connected to said second coaxial connector.

25. A vehicle antenna mast as described in claim 24, wherein the connector assembly has a tubular configuration for receiving said slide contact sleeve.

26. A vehicle antenna mast as described in claim 25, wherein said slide contact sleeve has an abutment stop means for positioning of said removable antenna mast in the base section.

27. A vehicle antenna mast as described in claim 24, wherein said slide contact sleeve has resilient means thereon for providing positive electrical contact between said slide contact sleeve and the connector assembly to complete a circuit with the AM/FM pickoff connector for conducting the AM/FM radio signals.

28. A vehicle antenna mast as described in claim 27, wherein said resilient means are cantilevered fingers on said slide contact sleeve.

29. A vehicle antenna mast as described in claim 24, wherein said slide contact sleeve, AM/FM tubular antenna portion and high frequency antenna portion terminate in a molded element which holds them in assembly.

30. A vehicle antenna mast as described in claim 29, wherein said second coaxial connector is held in assembly with said slide contact sleeve, AM/FM tubular antenna portion and high frequency antenna portion by said molded element.

31. A vehicle antenna mast as described in claim 30, wherein said high frequency antenna portion is operationally connected to said second coaxial connector by a coaxial feed line which extends through said molded element.

* * * * *